US012778242B2

(12) United States Patent
Ciccola

(10) Patent No.: US 12,778,242 B2
(45) Date of Patent: Nov. 3, 2026

(54) SHOE CREASE REMOVER INSERT

(71) Applicant: Jake Orland Ciccola, Athens, AL (US)

(72) Inventor: Jake Orland Ciccola, Athens, AL (US)

( * ) Notice: Subject to any disclaimer, the term of this patent is extended or adjusted under 35 U.S.C. 154(b) by 0 days.

(21) Appl. No.: 18/889,360

(22) Filed: Sep. 18, 2024

(65) Prior Publication Data

US 2025/0089854 A1 Mar. 20, 2025

Related U.S. Application Data

(60) Provisional application No. 63/539,094, filed on Sep. 18, 2023.

(51) Int. Cl.
*A43D 3/14* (2006.01)

(52) U.S. Cl.
CPC ..... *A43D 3/1491* (2013.01); *A43D 3/1433* (2013.01)

(58) Field of Classification Search
CPC ... A43D 3/1433; A43D 3/1441; A43D 3/1491
USPC ..... 12/128 R, 128 B
See application file for complete search history.

(56) References Cited

U.S. PATENT DOCUMENTS 1,853,896 A * 4/1932 Enrich ..... A43D 3/1441 12/114.2
2,975,444 A * 3/1961 Drew ..... A43D 3/1441 12/128 R
5,950,323 A * 9/1999 Wroth ..... A43D 3/1491 12/128 B
11,627,782 B2 4/2023 Drone
2003/0046778 A1* 3/2003 Sicurelli, Jr. ..... A43D 3/1433 12/128 H
2009/0031507 A1* 2/2009 McChesney ..... A43D 3/1433 12/114.2
2018/0192742 A1* 7/2018 Garcia ..... A43D 3/1416
2021/0289886 A1 9/2021 Stanley et al.

FOREIGN PATENT DOCUMENTS

GB 190910871 A * 9/1909 ..... A43D 3/1433

* cited by examiner

*Primary Examiner* — Ted Kavanaugh

(57) ABSTRACT

The present disclosure relates to a shoe crease remover insert designed to reduce the appearance of creases in the toe box of footwear, while simultaneously eliminating odors and moisture. The insert comprises a compressible body of sufficient size to fit inside footwear, characterized by shape retention, flexibility, and firmness. The shape retention ensures that the compressible body returns to its original form after compression for insertion. The flexibility allows for easy insertion into the footwear, and the firmness applies consistent pressure to the toe box, reducing creases without requiring any external force or intervention from the user. Additionally, the insert incorporates odor and moisture-reducing properties, making it multifunctional for footwear care.

12 Claims, 5 Drawing Sheets

SHOE CREASE REMOVER INSERT

CROSS-RELATED TO RELATED APPLICATIONS

Provisional application No. 63/539,094, filed on Sep. 18, 2023

STATEMENT REGARDING FEDERALLY SPONSORED RESEARCH OR DEVELOPMENT

"Not Applicable"

NAMES OF PARTIES TO A JOINT RESEARCH AGREEMENT

"Not Applicable"

INCORPORATION-BY-REFERENCE OF MATERIAL SUBMITTED ON A READ-ONLY OPTICAL DISC, AS A TEXT FILE OR AN XML FILE VIA THE PATENT ELECTRONIC SYSTEM

"Not Applicable"

STATEMENT REGARDING PRIOR DISCLOSURES BY THE INVENTOR OR A JOINT INVENTOR

"Not Applicable"

BACKGROUND OF THE INVENTION

In closed-toed footwear, the frontmost area that is intended for a wearer's toes to reside is defined as the toe box. Unfortunately, as footwear is worn, the toe box is prone to creasing, where the material has a visible indent or line. Toe box creasing is very undesirable, as it compromises the function and design of footwear, and if left untreated for too long, this creasing can become permanent. There are different types of devices that reside inside footwear while the footwear is worn that are intended to prevent creases forming in the toe box. However, as footwear is worn over time, the typical movements it goes through make toe box creases inevitable, even with a device inserted into the footwear intended to prevent or slow down the rate at which they occur. Another issue with these devices is that since they are inserted or used inside footwear while the footwear is being worn, they can cause discomfort to the wearer, due to the device altering the original shape of the interior of the footwear. These devices also easily move around inside the footwear which diminishes their usefulness, as well as cause further discomfort to the wearer. There also exist devices intended to be inserted into footwear as they are not worn, which help retain the current shape of a footwear and prevent damage during travel. Unfortunately, these devices, which are inserted into footwear, are not intended to apply pressure to the toe box region, meaning they do not reduce the appearance of creases while the footwear is not being worn. Many of these devices also require adjustments to be made to them prior to their use, which can be a timely and tedious process.

Another common problem with footwear is the odor that accumulates inside a footwear as it is worn over time. There are different devices and methods for reducing these odors, however many of these devices and methods offer diminishing results as the odor eliminating aspect requires a refill or replacement over time. These devices intended for footwear deodorizing also unintentionally shift their placement inside footwear as they are inserted, which could lead to them being located in an undesirable area of the footwear which offers little benefit to odor elimination.

Moisture accumulation inside footwear is also a common problem, especially as certain situations such as a hot climate, or inside washing machine, can cause an excess of moisture inside the footwear. While there are devices that can reduce moisture in footwear, these devices are unable to maintain the shape of the footwear and apply toe box pressure while also eliminating moisture. This would lead these devices to be unusable in a situation such as in a washing machine.

The present disclosure relates to a shoe crease remover insert designed to reduce the appearance of creases in the toe box of footwear, while simultaneously eliminating odors and moisture without requiring any external force or intervention from a user.

FIELD OF THE INVENTION

The present invention relates to shoe trees and shoe deodorizers, and more specifically to shoe trees for the toe box of shoes equipped with deodorizing means.

BRIEF SUMMARY OF THE INVENTION

The present disclosure is a shoe crease remover insert intended to be inserted into footwear that applies pressure to the toe box while eliminating odors and moisture. An exemplary shoe crease remover, according to an embodiment of the present disclosure, consists of a compressible body of sufficient size to fit inside an article of footwear, characterized by shape retention, flexibility, and firmness. The shape retention describes the ability for the compressible body to retain the original form prior to the application of any applied force needed to insert the compressible body into footwear. The flexibility describes the ability of the compressible body to be temporarily manipulated for insertion into footwear. The firmness describes the ability of the compressible body to provide sufficient force to the toe box of a footwear to reduce the appearance of toe box creases while inserted into a footwear with no external forces present.

BRIEF DESCRIPTION OF DRAWINGS

The accompanying drawings; serve to explain and illustrate principles of the invention to provide a further understanding of the invention and are incorporated in and constitute a part of this specification, illustrate embodiments of the invention and together with the description serve to explain the principles of the invention. The illustrations are not intended to depict every feature of actual embodiments.

1.

DETAILED DESCRIPTION OF THE INVENTION

Various specific details, relationships, and methods are presented to ensure a comprehensive understanding of the invention. However, those skilled in the relevant field will recognize that the invention may be practiced without one or more of these specific details or by employing alternative methods. Not all depicted acts or events are necessary to implement the methodologies outlined in the present invention.

The present disclosure is a shoe crease remover insert intended to be inserted into footwear that applies pressure to the toe box while eliminating odors and moisture. An exemplary shoe crease remover insert, according to an embodiment of the present disclosure, consists of a compressible body of sufficient size to fit inside an article of footwear, characterized by shape retention, flexibility, and firmness.

Figure 1A:
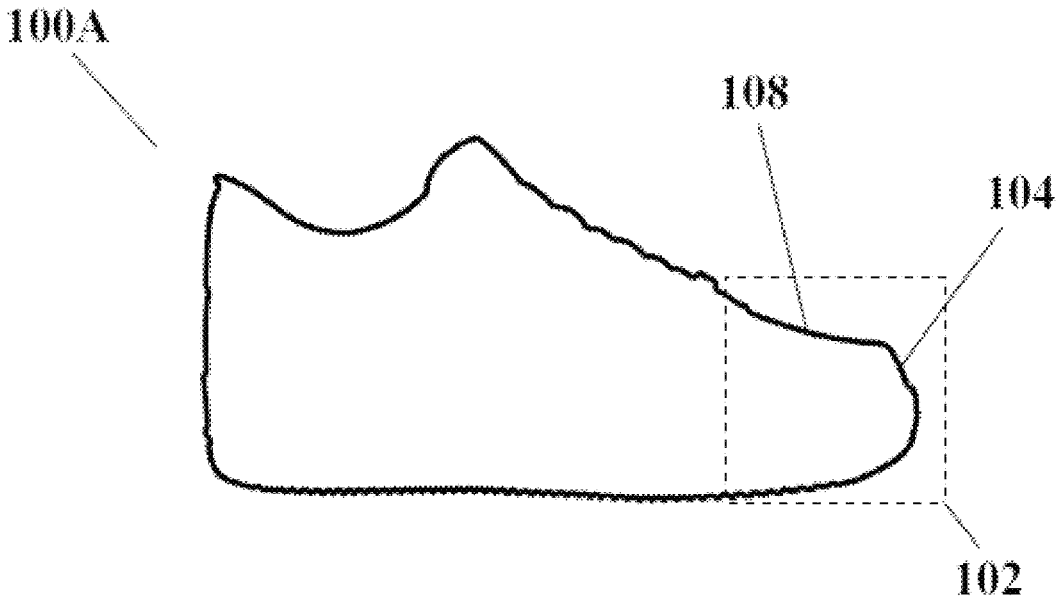
FIG. 1A (PRIOR ART)
FIG. 1A illustrates a footwear as known in the prior art;
2.

FIG. 1A shows a footwear 100A as known in the prior art. An exemplary footwear 100A includes three components in FIG. 1A, including a toe box 102, a toe cap 104, and a creasable area 108. The toe cap 104 describes the furthest portion of footwear that surrounds the toes of a wearer's foot. The toe box 102 describes the frontmost area of a footwear up until the toe cap 104, where a wearer's toes would reside.

The creasable area 108 of FIG. 1A shows an approximate region where creases can form in the footwear 100A during a wearer's utilization of the footwear. Exact dimensions and size of the creasable area 108 of FIG. 1A can vary depending on the type of footwear, and the bending of the footwear 100A during a wearer's use of the footwear 100A. The creases present in the creasable area 108 are problematic because during normal activities, the wearer will cause creases to appear in the creasable area 108 which diminish the functionality and appearance of the footwear 100A (FIG. 1A) and can lead to further issues such as denting or tearing. Additionally, during normal activities, the wearer can cause odors and moisture to accumulate in the footwear 100A (FIG. 1A).

This disclosure pertains to a shoe crease remover insert intended to fit into any type of footwear. Its purpose is to reduce the visibility of creases in the toe box, as well as to eliminate odors and moisture, all while being inserted into the footwear independently.

Figure 1B:
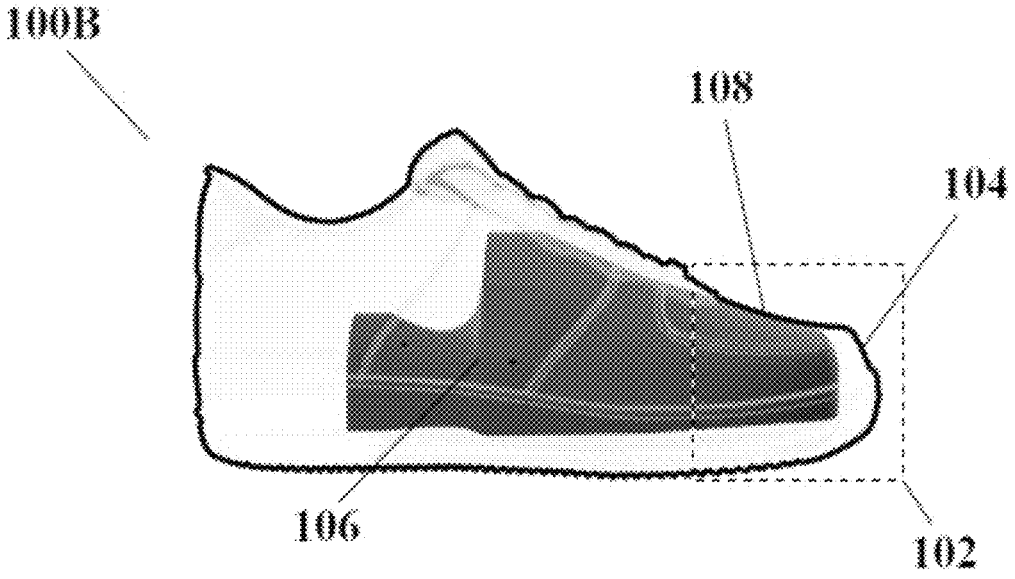
FIG. 1B illustrates a footwear with the shoe crease remover insert, inserted into the footwear;
3.

FIG. 1B shows a footwear 100B with the shoe crease remover insert 106 inserted into the footwear 100B. The exact positioning of the shoe crease remover insert 106 may be adjusted based on specifications such as the type of footwear, and the location of the creasable area 108 (FIG. 1B).

Figure 2A:
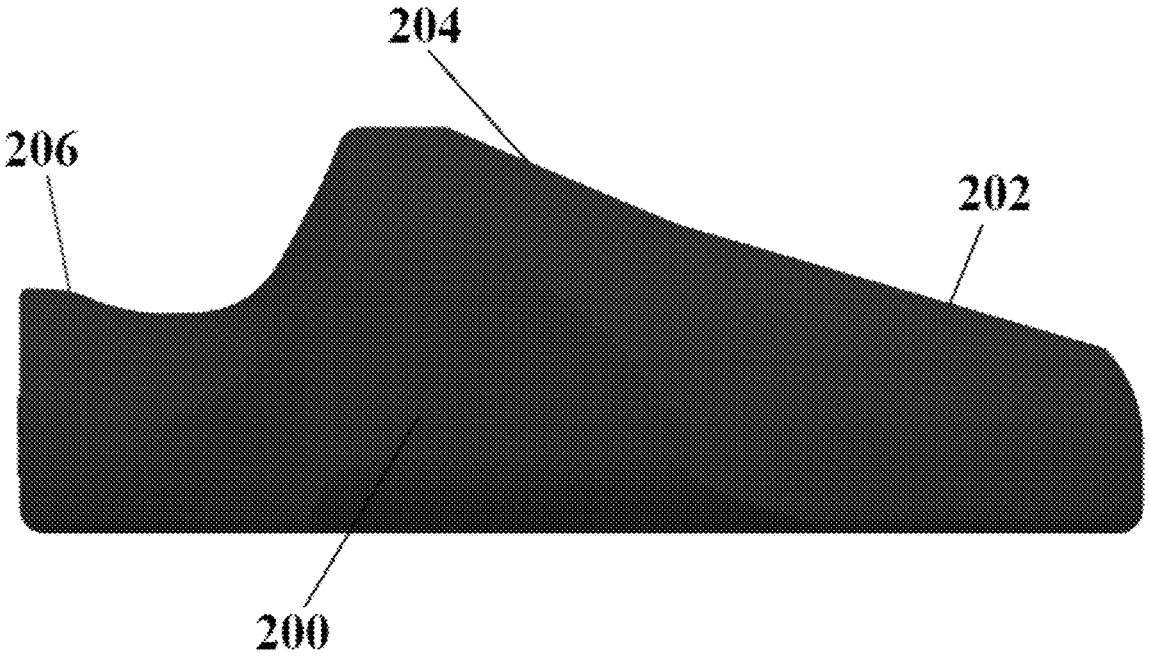
FIG. 2A illustrates a side view of the shoe crease remover insert;
4.
Figure 2B:
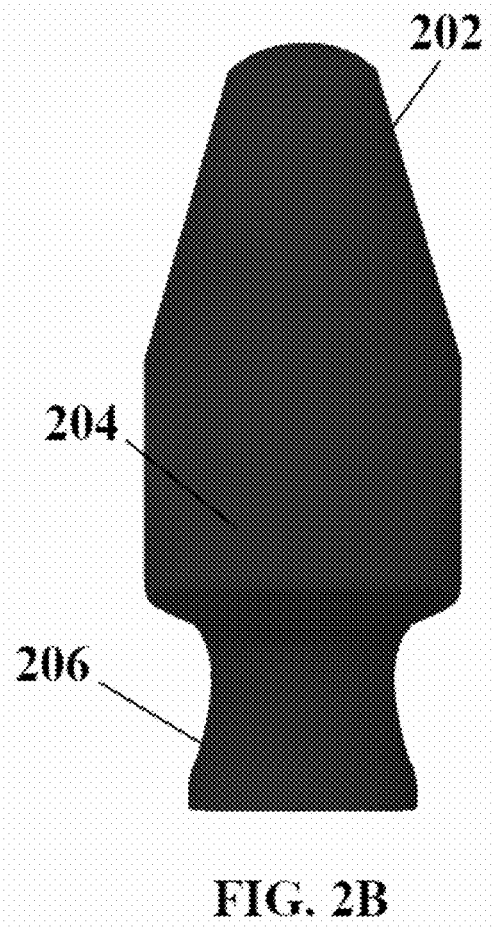
FIG. 2B illustrates a top view of the shoe crease remover insert;
5.
Figure 2C:
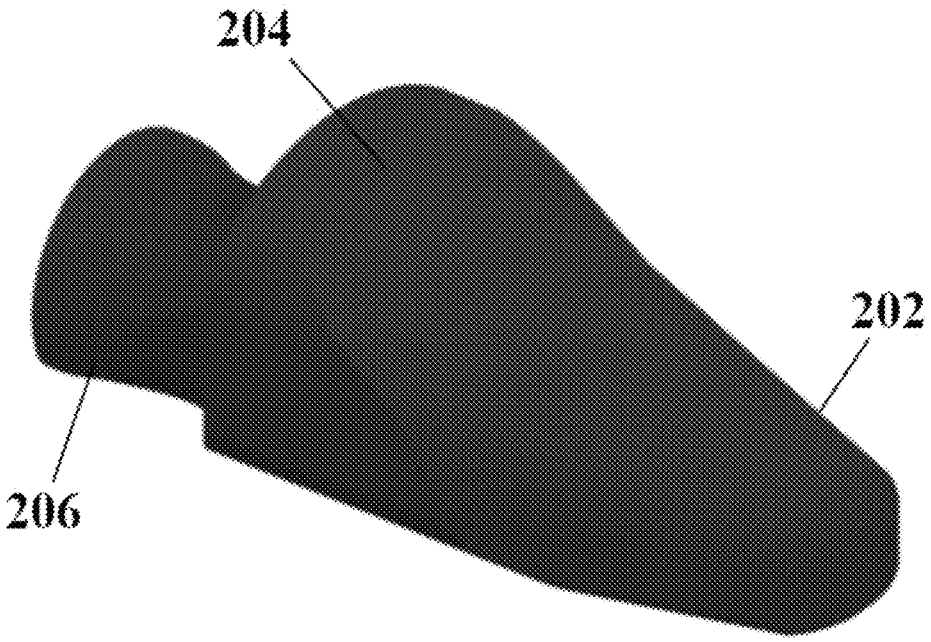
FIG. 2C illustrates an isometric view of the shoe crease remover insert.

As seen in FIG. 2A, the shoe crease remover insert 106 of FIG. 1B may comprise a compressible body 200, a shoe insertion edge 202, a toe box pressure application surface 204, and an operation shaft 206 (FIG. 2A). The shoe insertion edge 202 is terminally joined to the compressible body 200 (FIG. 2A). The toe box pressure application surface 204 is terminally joined to the compressible body 200 between the shoe insertion edge 202 and the operation shaft 206 (FIG. 2A). The operation shaft 206 is terminally joined to the compressible body 200 opposite the shoe insertion edge 202 (FIG. 2A).

The shoe crease remover insert 106 (FIG. 1B) is used by inserting the shoe crease remover insert 106 into a footwear 100B (FIG. 1B). The shoe crease remover insert 106 (FIG. 1B) may be temporarily flexed and the compressible body 200 (FIG. 2A) may be compressed to allow for proper insertion and positioning into a footwear 100B (FIG. 1B) by a user. FIG. 1B shows the possible placement of the shoe crease remover insert 106 inside a footwear, where a footwear 100B (FIG. 1B) shows a potential article of footwear that the shoe crease remover insert 106 can be placed inside. After the shoe crease remover insert 106 is properly inserted into a footwear, the flexibility of the shoe crease remover insert 106 allows for the shoe crease remover insert 106 to return to an original shape following any flexing or bending (FIG. 1B). Furthermore, the shape retention of the compressible body 200 (FIG. 2A) allows for any compression of the shoe crease remover insert 106 present during installation, to be reversed as the compressible body returns to an original shape. Thus, the shoe crease remover insert 106 (FIG. 1B) can have dimensions and shaping similar to the dimensions of the toe cap 104 and toe box 102 of FIG. 1B based on the style and size of the footwear.

In addition, the toe box pressure application surface 204 having an increased angle of elevation compared to the shoe insertion edge 202 (FIG. 2A), allows for the amount and location of pressure applied to the creasable area 108 to be adjusted in the toe box 102 as the user moves the shoe crease remover insert 106 closer or farther towards the toe cap 104 (FIG. 1B) inside the footwear.

Furthermore, the pressure applied to the creasable area 108 (FIG. 1B) can be determined by the compressible body 200 (FIG. 2A) returning to its original shape after installation, if that original shape is of greater height than that provided by the creasable area 108 (FIG. 1B). In addition, the pressure applied to the creasable area 108 by the shoe crease remover 106 can also be determined by the position of the shoe crease remover in the footwear 100B (FIG. 1B), as the toe box pressure application surface 204 (FIG. 2A) makes contact with the creasable area 108 (FIG. 1B). Since the toe box pressure application surface is of increasing angle, as a user moves the shoe crease remover insert 106 further into the footwear, closer to the toe cap 104 (FIG. 1B), the contact between the toe box pressure application surface 204 (FIG. 2A) and the creasable area 108 will increase, thus increasing the amount of pressure applied to the creasable area 108 (FIG. 1B). Once positioned into the desired location by the user, the shoe crease remover insert 106 (FIG. 1B) will apply this pressure, as described above, without any external forces or operation.

Such a shoe crease remover insert design provides advantages over conventional methods, such as filling the toe box of footwear with paper, cardboard, or plastic devices; as these methods do not possess sufficient firmness to apply adequate pressure to the creasable area 108 of the toe box 102 (FIG. 1B) while inserted into a footwear. In particular, since the shoe crease remover insert is composed of a compressible body 200 (FIG. 2A) with proper firmness that allows for the present shoe crease remover insert to apply adequate pressure to the creasable area 108 while residing in the toe box 102 (FIG. 1B) of different sizes and styles of footwear.

Furthermore, as the shoe crease remover insert 106 (FIG. 1B) consists of an operation shaft 206, and the compressible body 200 (FIG. 2A), which possess the ability to retain an original shape prior to any compression by the user during installation into footwear, there are no manual adjustments required by the user when inserting the shoe crease remover insert 106 into a footwear 100B (FIG. 1B).

In addition, such a shoe crease remover offers the ability to reduce the appearance of creases in the creasable area 108 (FIG. 1B), without external intervention. For example, other methods require a force supplied by a user, or user's foot for the device to function properly and provide benefit. Furthermore, to eliminate odor and moisture, many devices require an odor or moisture fighting substance or material be added to the device once inserted into footwear. However, once initially inserted into the footwear by the user, the shoe crease remover insert 106 (FIG. 1B) does not require any additional force or attention to reduce the appearance of creases, or eliminate odors and moisture that are present in the footwear.

Although the description above includes numerous specific details, these should not be interpreted as limitations on the scope of the invention; instead, they serve to illustrate one embodiment. Numerous other variations are possible. Such variants include the possible components of the shoe crease remover insert 106 (FIG. 1B), such as the compressible body 200, shoe insertion edge 202, toe box pressure application surface 204, and the operation shaft 206 (FIG. 2A), may be composed of any material able to provide proper flexibility, firmness, and shape retention, as described above. An example of such a material would be rubber. Additionally, such variants could include adhesives to be used to secure the shoe insertion edge 202, or the toe box pressure application surface 204 (FIG. 2A) to the creasable area 108 (FIG. 1A) to assist with applying adequate pressure to reduce the appearance of creases in footwear. Accordingly, the scope of the disclosure should be determined not by the embodiment illustrated, but by the appended claims and their legal equivalents.

What is claimed is:

1. A shoe insert comprising:

a resiliently compressible body extending along a longitudinal axis from a forward terminal end to a rear terminal end and having a substantially planar bottom surface extending continuously from the forward terminal end to the rear terminal end, the resiliently compressible body defining, in order along the longitudinal axis:

a forward toe portion having an upper surface rising in a rearward direction from the forward terminal end to a raised pressure-application portion;

a neck portion positioned rearward of the raised pressure-application portion and defining a concave upper recess and first and second opposed concave lateral recesses, the neck portion having a minimum transverse width less than a maximum transverse width of the raised pressure-application portion; and a terminal gripping portion positioned rearward of the neck portion, having a maximum transverse width greater than the minimum transverse width of the neck portion, and flaring laterally outward in the rearward direction from the neck portion toward the rear terminal end, wherein each of the forward toe portion, the neck portion, and the terminal gripping portion is resiliently compressible, and wherein the resiliently compressible body is configured to be compressed during insertion into a toe box of an article of footwear and, after insertion, to resiliently bias the raised pressure-application portion against an interior upper surface of the toe box while the article of footwear is unworn.

2. The shoe insert of claim 1, wherein the maximum transverse width of the terminal gripping portion is less than a maximum transverse width of the forward toe portion, and wherein an uppermost point of the terminal gripping portion is below an uppermost point of the raised pressure-application portion.

3. The shoe insert of claim 2, wherein the forward terminal end is rounded and the forward toe portion tapers in transverse width toward the rounded forward terminal end.

4. The shoe insert of claim 3, wherein a minimum height of the neck portion measured from the substantially planar bottom surface is less than a maximum height of the terminal gripping portion and less than a maximum height of the raised pressure-application portion.

5. The shoe insert of claim 4, wherein the terminal gripping portion includes a substantially planar rear terminal surface extending transverse to the longitudinal axis, and wherein the raised pressure-application portion has a convex transverse profile.

6. The shoe insert of claim 5, wherein the raised pressure-application portion includes a rearward-facing surface descending toward the concave upper recess of the neck portion.

7. The shoe insert of claim 6, wherein the maximum transverse width of the raised pressure-application portion is greater than the maximum transverse width of the terminal gripping portion.

8. The shoe insert of claim 1, wherein the forward terminal end is rounded and the forward toe portion tapers in transverse width toward the rounded forward terminal end.

9. The shoe insert of claim 8, wherein a minimum height of the neck portion measured from the substantially planar bottom surface is less than a maximum height of the terminal gripping portion and less than a maximum height of the raised pressure-application portion.

10. The shoe insert of claim 9, wherein the terminal gripping portion includes a substantially planar rear terminal surface extending transverse to the longitudinal axis, and wherein the raised pressure-application portion has a convex transverse profile.

11. The shoe insert of claim 10, wherein the raised pressure-application portion includes a rearward-facing surface descending toward the concave upper recess of the neck portion.

12. The shoe insert of claim 11, wherein the maximum transverse width of the raised pressure-application portion is greater than the maximum transverse width of the terminal gripping portion.

* * * * *